United States Patent [19]

Wilkinson et al.

[11] Patent Number: 4,537,311

[45] Date of Patent: Aug. 27, 1985

[54] SEAMLESS SUPPOSITORY DISPENSER

[75] Inventors: William R. Wilkinson, Houston, Tex.; Russell G. Sharp, 707 Santa Maria, Sugarland, Tex. 77478

[73] Assignee: Russell G. Sharp, Sugarland, Tex.

[21] Appl. No.: 507,965

[22] Filed: Jun. 27, 1983

[51] Int. Cl.[3] ..... B65D 83/04

[52] U.S. Cl. ..... 206/529; 206/528; 220/23.4

[58] Field of Search ..... 206/528, 529, 530; 220/23.4, 8

[56] References Cited

U.S. PATENT DOCUMENTS

| | | | |
|---|---|---|---|
| 136,973 | 3/1873 | Cutler | 217/6 |
| 534,633 | 2/1895 | Coleman | 249/127 |
| 1,300,867 | 4/1919 | Pick | 220/70 |
| 1,749,996 | 3/1930 | Brush | 206/529 |
| 2,012,535 | 8/1935 | Herrold | 206/529 |
| 2,530,127 | 11/1950 | Kubik | 249/121 |
| 2,797,805 | 7/1957 | Berard | 206/529 |
| 2,932,386 | 4/1960 | Ushkow | 249/127 |
| 3,059,766 | 10/1962 | Jordt | 206/529 |
| 3,104,665 | 9/1963 | Towns | 604/288 |
| 3,203,541 | 8/1965 | Rein | 206/539 |
| 3,483,908 | 12/1969 | Donovan | 150/55 |
| 4,272,049 | 6/1981 | Kindel | 249/83 |

FOREIGN PATENT DOCUMENTS

| | | | |
|---|---|---|---|
| 216299 | 9/1956 | Australia | 206/529 |
| 845004 | 8/1960 | United Kingdom | 206/528 |

*Primary Examiner*—William T. Dixson, Jr.
*Assistant Examiner*—Brenda J. Ehrhardt
*Attorney, Agent, or Firm*—Vaden, Eickenroht, Thompson & Jamison

[57] ABSTRACT

A combination mold and carrier for seamless suppositories. The dispenser has an elongated rectangular one-piece body of a flexible material that is dimensionally stable at ordinary temperatures. A plurality of suppository cavities of uniform constant tapers with rounded bottoms are formed in tubular members extending from the top side of the body. The body side surfaces are tapered with circular cross sections concentrically with the cavities. These side surfaces merge together adjacent the topside and separate into the individual tubular members towards the bottoms of the cavities. The cavities have rounded bottoms to facilitate ejection of suppositories by a manual pinching action. A circular flat base formed on the rounded walls support the body upright on a work surface with the cavities upright to receive a suppository mixture. A rectangular cover with open ends can be slideably mounted over the body in a telescoped relationship. In addition, the body can have identical cavities or cavities varying in axial dimension so that identical and graduated doses can be provided in the suppositories from the same medicinal casting compound.

6 Claims, 7 Drawing Figures

FIG. 1
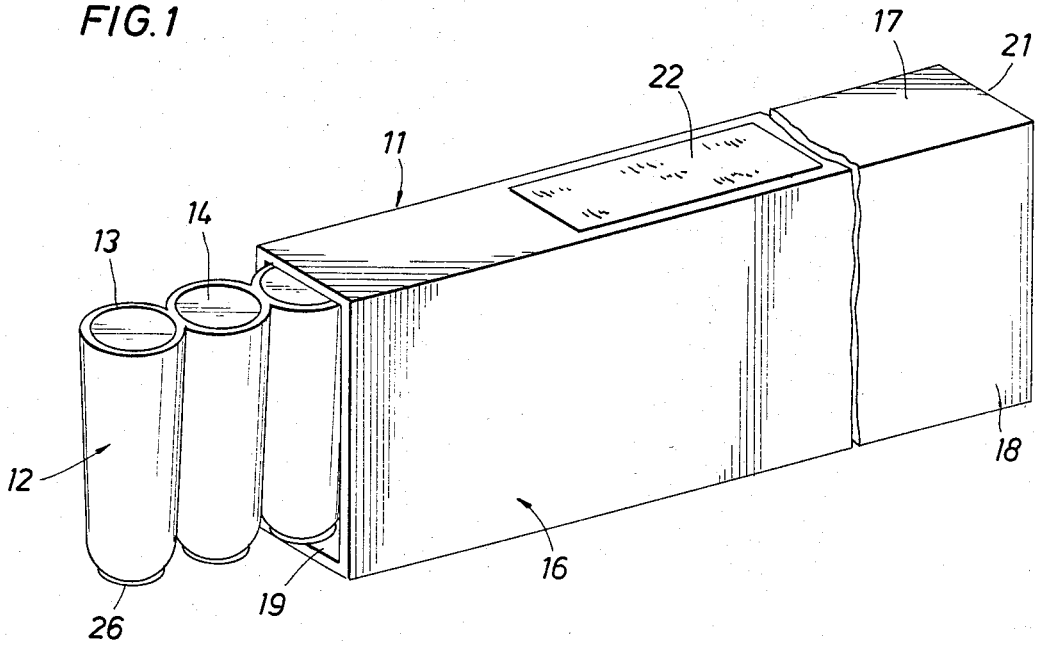
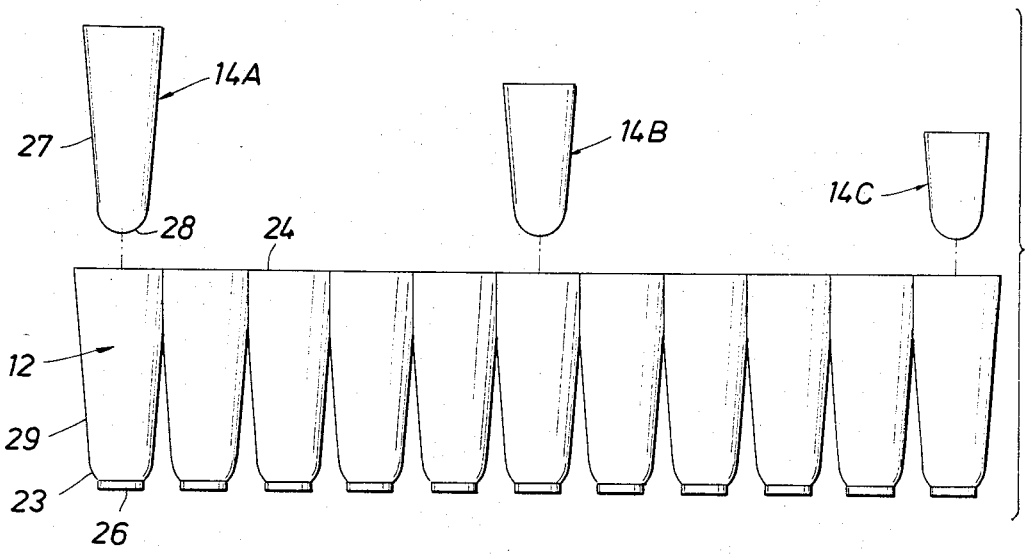
FIG. 2
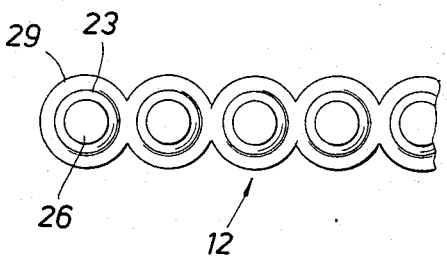
FIG. 3
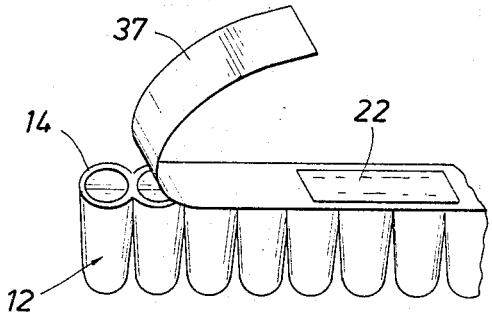
FIG. 7

SEAMLESS SUPPOSITORY DISPENSER

BACKGROUND OF THE INVENTION

1. Field of the Invention

This invention relates to special receptacles and packages for cast members such as medical and pharmacutical products, and more particularly to a combined mold and carrier dispenser for seamless suppositories.

2. Description of Prior Art

For many years suppositories had been manufactured in a central facility, such as a pharmacutical plant, and they were then shipped to pharmacies wherein a druggist could provide a certain type of suppository under a doctors prescription. Mainly, these suppositories were individually wrapped at the manufacturer in either a transparent film or an aluminum foil covering for convenience and protection of the suppository until the user opened the package. Although these suppositories had a very limited shelf life, a constant supply of fresh suppository packages could be provided to pharmacies so that the patient received a reasonably fresh medical product. About a decade ago, governmental agencies examined this situation wherein the drugs had either an interaction or a degradation that was timewise influenced. For example, an antibiotic type of suppository may have an adequate shelf life of two months in the normal distribution channels where the suppositories were kept in a proper environment. However, the drugs do begin deteriorating upon interblending into the suppository of certain bases. Therefore, government agencies required that these time degrading suppositories were removed from the marketplace. At this time, the pharmacist could not easily prepare a suppository from the products available to them. More particularly, all of the ingredients were available to the pharmacist wherein he could compound a proper suppository under a physicians prescription for a certain patient. However, the pharmacist did not have the necessary materials for molding, wrapping and packaging individually these suppositories in the same manner as had been provided to him by the pharmaceutical manufacturers.

Thus, there is a great need at this time to provide the pharmacist with a system wherein he can conveniently mold a certain prescribed drug into a suppository, and then package it for convenient handling by the patient. There have been many types of molds in which suppositories could be cast, and even some molds that would be usable by pharmacists within their usual practice. However, these molds are very inconvenient for the pharmacist because they require a multitude of special fixtures for use and handling. In addition, the packaging of the molded suppository for delivery to the patient leaves much to be desired.

In accordance with this invention, there is provided a unique mold and carrier which is readily employed by both the pharmacist and the patient who must ultimately utilize the medical drug prescribed by the doctor. In addition, this unique arrangement permits suppositories to be prepared quickly and correctly in a required unit dosage or a range of dosages of medicine and base by the pharmacist following a doctors prescription. As a result, the patient receives a very fresh dose of a certain medication prescribed in a specific amount for his use by a physician.

SUMMARY OF THE INVENTION

In accordance with this invention, there is provided a combined mold and carrier with uniformly tapered cavities with circular cross sections for cast members. Included is an elongated rectangular body of a flexible material that is dimensionally stable at ordinary temperatures. A cover may enclose the cavities to seal their open ends in the body. The body has formed into one of its sides a plurality of the uniformly tapered cavities in tapered tubular members with rounded bottoms defined by rounded walls to facilitate manual ejection of the cast members from each of the cavities. The tubular members merge together at one end but separate into individual tubular members towards the rounded bottoms of the cavities. The body has flat circular supporting bases formed on these rounded walls so that the body can rest upon a work surface with the cavities upright to receive the material forming the cast members.

In one embodiment, the cavities have different axial dimensions between their open ends and the rounded bottoms for cast members having graduated doses of medication.

DESCRIPTION OF THE DRAWINGS

FIG. 1 illustrates one embodiment of the present invention as a suppository dispenser with the body carrying cavities filled with a suppository mixture and the body withdrawn partially from its enclosing cover;

FIG. 2 is an elevation of the body shown in FIG. 1 and with several variable dosage suppositories ejected from their resident cavities;

FIG. 3 is a partial bottom view of the body shown in FIG. 2;

FIG. 7 illustrates peelable covers to enclose the cavities and suppositories in the body.

In the drawings, there will be several embodiments described for the present invention, and to simplify this description, like elements will carry like numerals in the several figures relative to the present seamless suppository dispenser.

DESCRIPTION OF PREFERRED EMBODIMENTS

Figure 4:
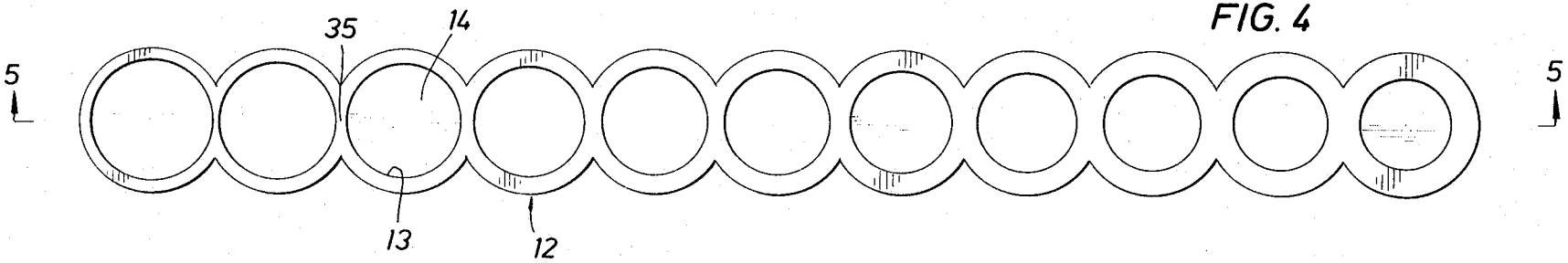
FIG. 4 is a plan view of the body illustrated in FIG. 2.

Referring now to the drawings, and particularly to FIG. 1, there is shown a dispenser 11 arranged in accordance with this invention. The dispenser 11 will be described in use to produce suppositories but it is to be understood, it can be used to produce as cast members other forms of personal products. The dispenser 11 has a unique body 12 provided with a plurality of cavities 13 in which can be a suppository 14 molded from a suitable medicine and base mixture. The body 12 is shown partially withdrawn from a plurality of thin walled panel members, (only members 17 and 18 are shown). These members are joined together at their longitudinal meeting edges. The cover 16 has open ends 19 and 21 so that it may be slid upon the body 12. Preferably, the cover 16 is formed of a noncontaminating material such as treated cardboard or plastic material of a relatively thin, but flexible nature. More particularly, the cover 16 resembles the rectangular open ended sliding cover employed upon a match box. The cover 16 may carry a label 22 for use by the pharmacists in denoting the necessary indicia of the medicated suppositories, the patients name and like information required under the various laws relating to the dispensing of drugs by pharmacists.

Referring now to FIG. 2, the body 12 is shown in greater detail. Several suppositories 14A, 14B and 14C are shown ejected from their respective cavity 13 by a pinching pressure applied manually upon the rounded bottom 23 that is carried upon the body 12. More particularly, the body 12 has a flat top surface 24 and a flat bottom surface 26. Tapered members 29 and the rounded walls 23 define each cavity 13 in the body 12. The shape of the cavity 13 alone determines the shape of the suppositories. It is preferred that the suppository 14 have a uniformly tapered portion 27 of circular cross section with a rounded bottom 28. Preferably, the suppositories have flat tops coextensive with the flat top surface 24.

Figure 5:
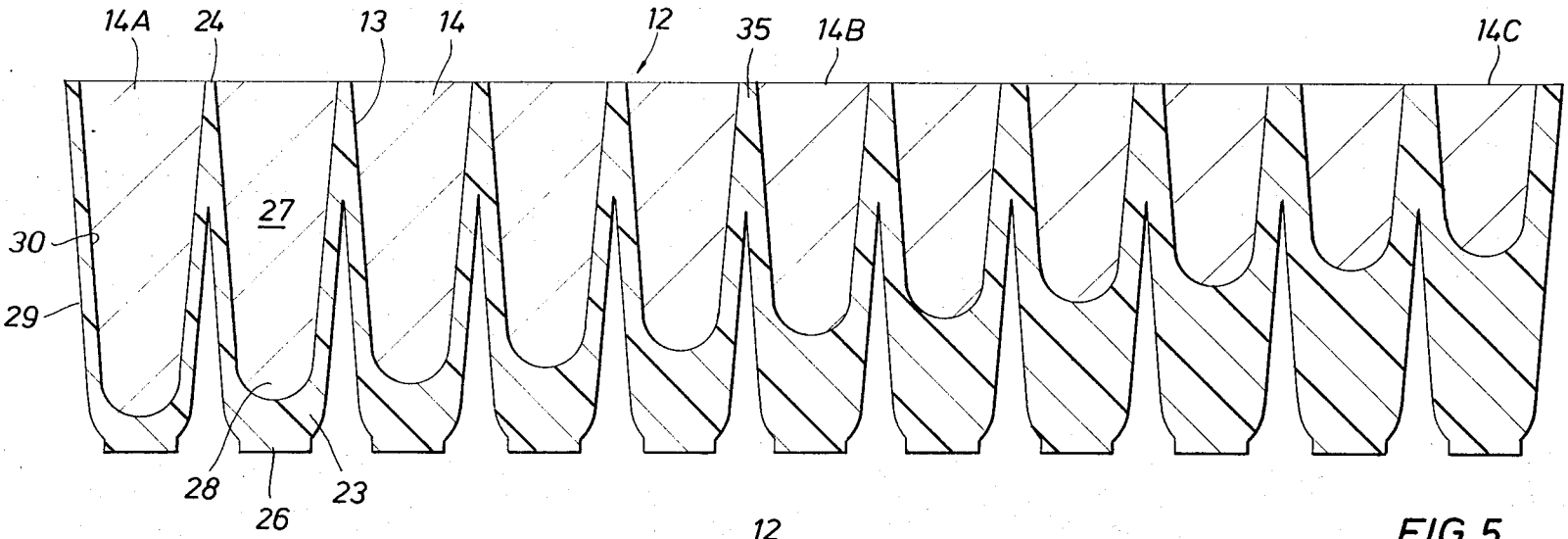
FIG. 5 is a vertical section of the body shown in FIG. 4 taken along line 5—5 thereof.

Referring to the sectional FIG. 5, it will be seen that each suppository is formed in identical conformance to the shape of the cavity in which it is cast. The rounded wall 23 which encloses the bottom of the cavity 13, has interiorly the particular shape desired for the rounded bottom 28 of the suppository. The tapered portion 27 is defined by a tubular member 29 which is a part of the body and extending from the top surface 24 towards the rounded walls 23. The tubular members merge together adjacent the top surface 24 but separate into individual tubular members for most of their axial dimension above the rounded walls 23.

It is preferred that the rounded walls 23 merge with the flat circular bottom 26 of the body. The tubular members 29 have a uniformly tapered wall surface 30 that extends from the top surface 24 to the rounded walls 23. Thus, each suppository will be identical at the same axial dimension taken from its rounded bottom 28. The cavity 23 enclosed by the rounded wall 23 does extend to a selected point slightly above the flat surface 26. The suppository is uniquely removed by simple manual pinching action of the fingers which may be applied to the rounded wall 23 in an upwardly direction, and also to the sides of the body along tubular member 29, so as to positively eject the suppository with a piston-like action. Best results are obtained when the walls 30 have a diverging taper of about 8 degrees relative to the axis of the cavity 13. Lesser taper makes suppository ejection difficult while greater taper causes separation of the suppository at its bottom 28 within the cavity.

It will be remembered that the suppository 14 is formed of a medicine and a base which resembles a substantially firm waxy mixture that is completely contained within the cavity 13. Thus, any pressure applied to the rounded wall 23 and tubular member 29 will force the suppository upwardly from the cavity 13 in a positive displacement manner and very little, if any, of the suppository 14 will remain within the cavity 13 with the aforementioned taper of 8 degrees. Therefore, the patient who is to use the suppository 14 will receive the complete dosage mixture.

Although all the cavities may have identical axial dimensions, this dimension may be graduated in the cavities across the body. For example, the suppository 14A may be one-half the length of suppository 14B, and suppository 14B is one-half the dose of suppository 14C wherein their respective lengths are in a ratio of 1:2:4. Thus, the use of graduated doses in the suppositories is easily obtained by adjusting the cavities in length to a desired ratio, and the same medicinal mixture can then be cast into all the cavities. This graduated suppository dosage is one advantage provided by the selected axial length arrangement of the cavities in the body.

In addition, the cavities all have the same uniform tapered portion 27 while only their axial dimension from the rounded bottom 28 needs to be varied, if desired. If the body is molded, the pins forming the cavities are all identical and only their extension below the top surface 24 is adjusted. As a result, the same molding assembly can be used to provide the body with identical cavities, or a selected arrangement of cavity sizes.

The web 35 of material in the body is essentially of the same thickness between the cavities as in walls 30 of the tubular members 29 when the cavities are of equal sizes. These walls 30 are circular in cross section and concentric with the cavities and the round base 26. The walls 30 should be very flexible in assisting removal of the suppositories and also to prevent shrinkage and warping during molding of the body. Although the body 12 has a certain flexible pliant characteristic, it can be compressed in this web 35 to assist in ejecting the suppository once it has been pinched from the bottom end.

The flat supporting surface 26, is in the same plane for all of the body 12. More particularly, the flat circular surface 26 may be formed integrally upon the end with the rounded wall 23. As a result, the body may be placed upright upon a flat working surface by the pharmicist to facilitate the pouring of a proper suppository mixture into the cavities 13.

It will be seen that the body 12 must have a certain flexible pliant nature to permit (1) the proper filling of the cavities with the suppository mixture, (2) the safe storage of these molded suppositories, and (3) the convenient complete removal of them by the patient when their use is desired. More particularly, the body 12 is preferably formed of a flexible rubber compound, and the thermoplastic rubber compounds have found good utility in this manufacture. Although many rubber compounds may be employed for this purpose, it is preferred to use the butadiene-styrene polymers for this purpose. The thermoplastic rubber compounds which are available under the tradenames "KRATON D & G" may be employeed with good results in this invention. These rubber compounds have a Shore hardness of between 40–90 and are of the relatively high temperature variety so they can be molded into bodies 12 which will maintain their dimensional characteristics at ordinary temperatures employed for the manufacture, dispensing and using of suppositories. In general, this temperature range is between that of normal refrigeration of about 40° F. and the temperatures employed during the molding of the suppository material which may reach 100° F. However, there is some tolerance in the temperature range in which the body 12 will be required to be employed. There are many flexible materials besides these rubber compounds that may be selected from plastic suppliers information for manufacturing of the body 12. The body 12 will usually be molded in one-piece in a high pressure type of molding machine which is readily selected by those skilled in the molding art.

Figure 6:
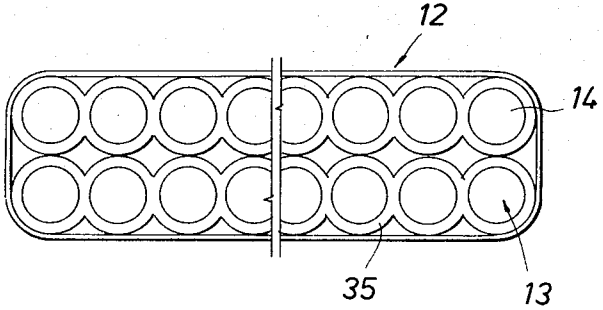
FIG. 6 illustrates in plan the bodies nested together side-by-side after filling with the suppository mixture by the pharmacist.

In addition to the necessary physical properties required for the flexible material from which the body 12 is manufactured, this material must be non-contaminating drugwise for safe use with the particular suppository mixture to be employed. In general, the suppository 14 is a small solid which is shaped for ready non-oral introduction into one of the orifices of the body. The suppository is made of a medicated substance which is solid at ordinary temperatures, but which melts at body temperature. The suppository is usually formed of a base which may be theobroma oil, glycerinated gelatin, hydroginated vegetable oils, mixtures of polyethelene glycols of various molecular weights and fatty acid esters of polyethelene glycol. The suppository 14 may vary in size from having a weight between 1 and 5 grams and may have a length from approximately 3 centimeters to 7 centimeters depending upon its medicated usage for the patient. In general, the medicine is thoroughly mixed into the cavities 13 of the body 12. In some instances, it may even be desired that the base not be in a molten state, but in a putty-like state. The medicine is intermixed mechanically into the base. Then, the resultant mixture of medicine and base is pressed into each cavity to totally fill it void free. In either event, the body 12 will usually be filled with it standing upon a flat base surface 26 upon a suitable work surface, such as a work table or countertop employed by the pharmacist. For facilitating preparation of the suppositories, several upright bodies may be held together by a suitable fastener such as rubber band 38 which surrounds them, as can be seen in FIG. 6. Thus, the bodies 12 are placed in a vertically oriented side-by-side relationship and secured conveniently together while resting upon their flat surfaces 36 upon the work surface. Then, the mixture may be readily poured into each of the cavities 13 flush with the top surface 24 of the body 12. If desired, the cavities 13 may be over filled and then the excess suppository material scraped flush with the surface 12 by using a spatula or like instrument. Now, the body 12 may be inserted into the cover 16. The body 12 may first be cooled under suitable refrigeration, if desired, so that the suppository 14 is completely hardened before insertion into the cover 16. Then, the suppository containing body 12 with the label 22 applied to cover 16 can be delivered to the patient in accordance with the physicians instructions.

It will be apparent that the bodies should be delivered from the manufacturer-supplier to the pharmacist in very compact packaging. For this purpose, the bodies 12 are readily internested into either a vertical or flat packaging where the rounded walls 23 and base 26 of one body are received within the cavity 13 of the adjacent body. In this arrangement, the rounded wall 23 fits into the mouth of the cavity 13 and is in abutment with the top surface 14 of the adjacent body. This nesting permits the bodies to be readily packaged conveniently in a very compacted form. In like manner, the covers 16 are readily flattened upon their diagonal seams and packaged together in the same convenient carton if desired.

The cavities and suppositories in the body 12 may be enclosed by any suitable arrangement besides the cover 16. For example, each cavity may be covered by a separate cover material. However, the usage of a one-piece cover material, such as peelable films 37 carried on the surface 24 is of advantage, as can be seen in reference to FIG. 6. Alternatively adhesive tape and heat shrinking films could also be used as the cover material.

It will be apparent that the body 12 is monolithic or unitary without any loose parts or other pieces required for the molding of the suppositories. Thus, the pharmacist is not presented with a large group of varying covers, holders, etc. required for using the present suppository dispenser. Likewise, since the body 12 is unitary, there are no seams in a suppository 14 which is formed in it. This is of advantage relative to earlier practices where the suppositories were molded in leaf type molds at a pharmaceutical house, and then packaged individually.

If desired, the body 12 can be used to form a cast member from a material such as hand lotion or lip balm or other personal products besides the suppository 14.

From the foregoing, it will be apparent that there has been provided a very unique type of combination mold and carrier which is arranged into the personal product dispenser of the present invention. Although certain changes may be made from the present description, it is envisioned that these changes do not deviate from the teachings of the present invention. It is intended that the claims appended to this specification cover such obvious changes in design as have been indicated in the present description. It is also intended that the present description be taken as an illustration of the present invention and only the claims following hereinafter define the limitation of this invention.

What is claimed is:

1. A combination mold and a carrier for suppositories, comprising:

(a) an elongated rectangular body of flexible material that is dimensionally stable at ordinary temperatures;

(b) said body having a width substantially less in dimension than in height, and a length substantially greater than both its width and height;

(c) said body having parallel planar top and bottom surfaces, and tapered side surfaces that merge together adjacent said top surface and separate into individual tubular members as they extends towards said bottom surfaces;

(d) a plurality of tapered cavities formed side-by-side within said body and said cavities uniformly spaced laterally along said top surface and extending axially in a uniform constant taper within each tubular member through said body towards said bottom surface;

(e) said cavities each having rounded walls defining a rounded bottom of said cavities to facilitate suppository ejection from each cavity by a manual pinching action upon said rounded walls and said tubular members, said rounded bottom beginning in curvature at a predetermined dimension above said bottom surface of said body whereby said volumetric capacity of each cavity can be adjusted;

(f) said rounded walls at their apex carrying flat supporting bases in parallel to said top surface to receive a suppository mixture downwardly into said cavities; and (g) said rounded walls connected by tubular walls to said top surface and said tubular walls about said cavities forming a common wall of uniform thickness between said cavities in said body.

2. The combination mold and carrier of claim 1 wherein said rounded walls extend from said bottom surface in a circular cross section having an outside diameter that is less in dimension than the openings of said cavities in said top surface whereby a plurality of bodies can be nested in vertical stacked relationship with said rounded walls received in said cavities and said top and bottom surfaces in abutment.

3. The mold and carrier of claim 1 wherein a plurality of said bodies can be stacked side-by-side on their flat supporting bases for convenient filling of said cavities.

4. The mold and carrier of claim 1 wherein said mold and carrier is enclosed by cover means, and said cover means is box-like and provided by elongated thin panel members secured at their longitudinal meeting edges defining rectangular open ends to receive said body.

5. The mold and carrier of claim 1 wherein said mold and carrier is enclosed on said top surface by a one-piece peelable film material.

6. A combination mold and a carrier for suppositories, comprising:

(a) an elongated rectangular one-piece body of flexible material that is dimensionally stable at ordinary temperature;

(b) said body having a substantially less in dimension than in height, and a length substantially greater than both its width and height;

(c) said body having in parallel planar top and bottom surfaces, and upright tapered side surfaces that merge together adjacent said top surface and separate into individual tubular members as they extend towards said bottom surfaces;

(d) a plurality of tapered cavities with circular cross sections formed within said body and said cavities uniformly spaced laterally along said top surface and extending axially in a uniform constant taper of about 8 degrees within each of said tubular members through said body towards said bottom surface, and said cylindrical openings being concentric with said tapered side surfaces;

(e) said cavities each having rounded walls defining a rounded bottom of said cavities to facilitate suppository ejection from each cavity by a manual pinching action upon said rounded walls and said tubular members, said rounded bottoms beginning in a curvature at a predetermined dimension above said bottom surface of said body whereby the volumetric capacity of each cavity can be adjusted; and (f) said rounded walls at their apex carrying flat supporting circular bases in parallel to said top surface and concentric with said cavities whereby said body can rest upon a work surface to receive a suppository mixture coaxially downwardly into said cavities.

* * * * *